US007175544B2

(12) United States Patent
Yamagishi et al.

(10) Patent No.: US 7,175,544 B2
(45) Date of Patent: Feb. 13, 2007

(54) MULTI-PIECE SOLID GOLF BALL

(75) Inventors: Hisashi Yamagishi, Chichibu (JP); Hiroshi Higuchi, Chichibu (JP); Junji Hayashi, Chichibu (JP); Akira Kawata, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 700 days.

(21) Appl. No.: 09/764,307

(22) Filed: Jan. 19, 2001

(65) Prior Publication Data

US 2001/0002373 A1 May 31, 2001

Related U.S. Application Data

(62) Division of application No. 09/129,883, filed on Aug. 6, 1998.
(60) Provisional application No. 60/058,563, filed on Sep. 11, 1997.

(30) Foreign Application Priority Data

Aug. 11, 1997 (JP) ..... 9-228902

(51) Int. Cl.
*A63B 37/04* (2006.01)
*A63B 37/06* (2006.01)
*A63B 37/12* (2006.01)
*A63B 37/14* (2006.01)

(52) U.S. Cl. ..... 473/378; 473/371
(58) Field of Classification Search ..... 473/351, 473/378, 379, 380, 382, 383, 384, 371
See application file for complete search history.

(56) References Cited

U.S. PATENT DOCUMENTS 4,840,381 A 6/1989 Ihara et al.
5,695,413 A * 12/1997 Yamagishi et al. .. 273/DIG. 22
5,779,563 A * 7/1998 Yamagishi et al. ..... 473/371
5,830,087 A 11/1998 Sullivan et al.
6,210,292 B1 * 4/2001 Higuchi et al. ..... 473/374

FOREIGN PATENT DOCUMENTS

GB 2 298 583 9/1996
GB 2 301 291 12/1996
GB 2 306 118 4/1997
JP 09285566 A * 11/1997
JP 09290034 A * 11/1997

OTHER PUBLICATIONS

European Search Report dated Apr. 25, 2001.

* cited by examiner

*Primary Examiner*—Eugene Kim
*Assistant Examiner*—Alvin A. Hunter, Jr.
(74) *Attorney, Agent, or Firm*—Sughrue Mion, PLLC

(57) ABSTRACT

A multi-piece solid golf ball comprising a solid core and a cover of two inner and outer layers surrounding the core. The outer cover layer has a surface formed with a plurality of dimples such that the product of the Shore D hardness of the inner cover layer and the outer cover layer, a proportion $V_R$ (%) of the total of the volumes of dimple, and the distortion of the core have a predetermined relationship. The dimples include at least three types of dimples which are different in at least one of a diameter, a depth, and a value $V_0$ which is the volume of one dimple space defined below a plane circumscribed by the dimple edge divided by the volume of a cylinder whose bottom is the plane and whose height is the maximum depth of the dimple from the bottom.

20 Claims, 3 Drawing Sheets

MULTI-PIECE SOLID GOLF BALL

CROSS REFERENCE TO RELATED APPLICATION

This application is a divisional application of U.S. Non-provisional application Ser. No.: 09/129,883 filed Aug. 6, 1998. application Ser. No. 09/1 29,883 claims priority from U.S. Provisional Application 60/058,563 filed on Sep. 11, 1997, and Japanese Patent Application No.: 9-228901 filed on Aug. 11, 1997. The disclosures of the documents mentioned in this paragraph are incorporated herein by reference, in their entirety.

BACKGROUND OF THE INVENTION

1. Field of the Invention

This invention relates to a multi-piece solid golf ball having a cover of inner and outer layers and more particularly, to a multi-piece solid golf ball in which cover hardness and dimples are optimized to improve flight distance performance.

2. Prior Art

Golf balls are generally classified into solid golf balls in which a solid core is enclosed with at least one layer of cover and wound golf balls in which a wound core in the form of a center ball having thread rubber wound thereon is enclosed with a cover. Numerous modifications were heretofore proposed to improve flight distance properties, spin performance, and controllability.

As one example of such proposals, an approach of increasing a spin rate by forming the cover soft or to low hardness falls under the category of the prior art. In particular, improvements in multi-piece solid golf balls are by adjusting the composition and hardness of the thermoplastic resin of which each cover layer is constructed. For example, if it is desired to increase a spin rate, the outer cover layer coming in direct contact with the club face is formed relatively soft in consideration of a friction phenomenon upon impact. Inversely, if it is desired to decrease a spin rate, the outer cover layer is formed relatively hard.

However, the multi-piece solid golf balls wherein the outer cover layer is formed relatively soft have the problem that a desired spin rate is not always obtained because the hardness of the inner cover layer in contact with the outer cover layer is not optimized. Therefore; the deformation process upon impact differs among the respective layers.

Also proposed were techniques of forming the inner cover layer relatively soft in order to increase a spin rate and forming the outer and inner cover layers relatively soft in order to further increase a spin rate. There arises the problem that the trajectory changes in flight to adversely affect the flight distance.

On the other hand, for those golf balls required to have flight distance performance, it is difficult to form dimples suitable for the spin range and restitution which vary with the cover hardness. Golf balls with dimples of one type suffer from the problem that they rise too high or drop to detract from flight distance performance.

SUMMARY OF THE INVENTION

The present invention has been made under the above-mentioned circumstances and its object is to provide a golf ball comprising a solid core enclosed with two inner and outer layers enabling an increase of flight distance.

Making extensive investigations to achieve the above object, the inventors have found in connection with a multi-piece solid golf ball comprising a solid core and a cover of two inner and outer layers surrounding the core, the outer cover layer being formed in the surface with a plurality of dimples, that a spin rate is approximately explained in terms of a product of the Shore D hardness of the inner cover layer multiplied by the Shore D hardness of the outer cover layer. More particularly, a higher spin rate is obtained when the product of the Shore D hardnesses of the inner and outer layers has a relatively smaller value. Inversely, a reduced spin rate is obtained when the same product has a relatively larger value. One effective means for taking full advantage of the spin property dependent on the product of the Shore D hardnesses of the inner and outer layers and improving the flight performance of the golf ball is to divide the range of the product into sub-ranges and form dimples so as to satisfy the following two requirements associated with the sub-ranges of the product. More particularly, it has been found effective as a first requirement to specify a proportion $V_R$ (%) of the total of the volumes of dimple spaces each defined below a plane circumscribed by the dimple edge to the overall volume of a phantom sphere given on the assumption that the golf ball surface is free of dimples. A second requirement is to form at least three types of dimples which are different in at least one of a diameter, a depth, and a value $V_0$ which is the volume of one dimple space defined below a plane circumscribed by the dimple edge divided by the volume of a cylinder whose bottom is the plane and whose height is the maximum depth of the dimple from the bottom. The inventors have also found that to specify the distortion of the solid core and to specify the Shore D hardness of the inner and outer cover layers are more effective. The present invention is predicated on this finding.

Specifically, the present invention provides:

1) A multi-piece solid golf ball comprising a solid core and a cover of two inner and outer layers surrounding the core, the outer cover layer having a surface formed with a plurality of dimples, characterized in that a product of the Shore D hardness of said inner cover layer multiplied by the Shore D hardness of said outer cover layer and a proportion $V_R$ (%) of the total of the volumes of dimple spaces each defined below a plane circumscribed by the dimple edge to the overall volume of a phantom sphere given on the assumption that the golf ball surface is free of dimples satisfy any one of the following combinations (1) to (5):

(1) the product of Shore D hardnesses of inner and outer cover layers: 1,500 to less than 2,000

$V_R$: 0.8 to 1.1%

(2) the product of Shore D hardnesses of inner and outer cover layers: 2,000 to less than 2,500

$V_R$: 0.75 to 1.05%

(3) the product of Shore D hardnesses of inner and outer cover layers: 2,500 to less than 3,000

$V_R$: 0.7 to 1%

(4) the product of Shore D hardnesses of inner and outer cover layers: 3,000 to less than 3,500

$V_R$: 0.65 to 0.95%

(5) the product of Shore D hardnesses of inner and outer cover layers: 3,500 to 4,000

$V_R$: 0.6 to 0.9%, and said dimples include at least three types of dimples which are different in at least one of a diameter, a depth, and a value $V_0$ which is the volume of one dimple space defined below a plane circumscribed by the dimple edge divided by the volume of a cylinder whose bottom is the plane and whose height is the maximum depth of the dimple from the bottom.

2) The multi-piece solid golf ball of 1) wherein the solid core has a distortion of 2.6 to 6.5 mm under an applied load of 100 kg.

3) The multi-piece solid golf ball of 1) or 2) wherein both the hardnesses of the inner and outer cover layers are up to 63 in Shore D hardness.

DETAILED DESCRIPTION OF THE INVENTION

Figure 1:
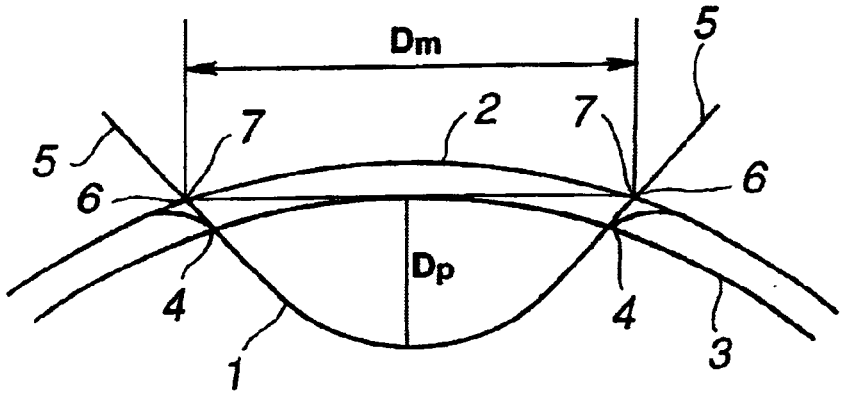
FIG. 1 is a cross-sectional view of a dimple illustrating how to calculate a value $V_0$.

The invention will now be described in more detail. The multi-piece solid golf ball 28 of the invention is defined as comprising a solid core 20 and a cover of 2*n* inner and 2*n* outer layers 14, 16 surrounding the core, the outer cover, layer having a surface formed with a plurality of dimples 1. When the range of the product of the Shore D hardnesses of the inner and outer cover layers is divided into sub-ranges, a dimple parameter can be specified in conjunction with each of the sub-ranges of the product for achieving optimization.

First, the solid core 20 is described. The solid core may be formed of a well-known rubber composition. For example, it is prepared by mixing 1,4-cis-polybutadiene as a base with a well-known crosslinking agent, co-crosslinking agent, filler and so on in a roll mill, introducing a necessary amount of the composition into a solid core-shaping mold, and effecting vulcanization and heat molding. In this regard, the solid core may consist of a single layer or plural layers. In the practice of the invention, the solid core preferably undergoes a distortion or deformation of 2.6 to 6.5 mm, more preferably 2.7 to 6.3 mm, most preferably 2.8 to 6.0 mm under an applied load of 100 kg. A distortion of less than 2.6 mm (hard core) would exacerbate hitting feel. A distortion of more than 6.5 mm (soft core) would result in a ball with less restitution.

The golf ball of the invention is constructed by forming a cover of two (inner and outer) layer structure, 14, 16, around the aforementioned solid core 20. The inner and outer layers may be formed of well-known cover stocks. Specifically, ionomer resins, thermoplastic polyester elastomers, and thermoplastic polyurethane elastomers may be used alone or in admixture of two or more. In the practice of the invention, cover stocks must be selected such that the product of the Shore D hardness of the inner cover layer multiplied by the Shore D hardness of the outer cover layer fall in the range of 1,500 to 4,000.

The Shore D hardnesses of the inner and outer cover layers may be identical with or different from each other insofar as the product of Shore D hardnesses falls in the range of 1,500 to 4,000. That is, the Shore D hardness of the inner cover layer may be substantially identical with the Shore D hardness of the outer cover layer. Alternatively, either one of the inner and outer cover layers may be softer or harder than the other. The hardness difference between the inner and outer cover layers may be appropriately determined.

Preferably the outer cover layer 16 has a Shore D hardness of up to 63, more preferably 30 to 62, especially 35 to 61. With a Shore D hardness of more than 63, there is a risk that no spin is acquired due to a slip phenomenon between the cover and the club face. If the hardness of the outer cover layer is below 30, the ball would lose restitution.

On the other than, the inner cover layer preferably has a Shore D hardness of 28 to 63. Restitution would be lost with an inner cover layer hardness of less than 28 whereas hitting feel would be exacerbated by a hardness above 63.

The method for forming the inner and outer cover layers around the solid core is not critical and can be in accord with conventional ones. Included are a method of enclosing the solid core with a pair of hemispherical half cups of an inner cover layer composition, compression molding to join the cups to the core, placing it in an injection mold, and injecting an outer cover layer composition and another method of forming half cups from inner and outer cover layer compositions, respectively, mating them to form half cups of the two layer structure, enclosing the solid core with the half cups, and effecting compression molding.

The thus formed cover of the inner and outer layers may have any desired gage. Usually the inner cover layer has a gage of 0.5 to 3.0 mm, especially 1.0 to 2.5 mm, the outer cover layer has a gage of 0.5 to 2.5 mm, especially 1.0 to 2.3 mm, and the cover has a total gage of 1.0 to 5.5 mm, preferably 1.5 to 5.0 mm, especially 1.5 to 3.5 mm.

The multi-piece solid golf ball of the invention has a plurality of dimples 1 formed in the outer cover layer. The dimples are formed such that when the product of the Shore D hardness of the inner cover layer multiplied by the Shore D hardness of the outer cover layer is in the range from 1,500 to 4,000, which is divided into sub-ranges, a factor $V_R$ associated with the dimples, that is, a proportion $V_R$ (%) of the total of the volumes of dimple spaces each defined below a plane circumscribed by the dimple edge to the overall volume of a phantom sphere given on the assumption that the golf ball surface is free of dimples has the following value.

(1) The product of Shore D hardnesses of inner and outer cover layers: 1,500 to less than 2,000

$V_R$: 0.8 to 1.1%

(2) The product of Shore D hardnesses of inner and outer cover layers: 2,000 to less than 2,500

$V_R$: 0.75 to 1.05%

(3) The product of Shore D harnesses of inner and outer cover layers: 2,500 to less than 3,000

$V_R$: 0.7 to 1%

(4) The product of Shore D hardnesses of inner and outer cover layers: 3,000 to less than 3,500

$V_R$: 0.65 to 0.95%

(5) The product of Shore D hardnesses of inner and outer cover layers: 3,500 to 4,000

$V_R$: 0.6 to 0.9%

More preferred ranges of $V_R$ are given below.

(1) The product of Shore D hardnesses of inner and outer cover layers: 1,500 to less than 2,000

$V_R$: 0.82 to 1.08%

(2) The product of Shore D hardnesses of inner and outer cover layers: 2,000 to less than 2,500

$V_R$: 0.77 to 1.03%

(3) The product of Shore D hardnesses of inner and outer cover layers: 2,500 to less than 3,000

$V_R$: 0.72 to 0.98%

(4) The product of Shore D hardnesses of inner and outer cover layers: 3,000 to less than 3,500

$V_R$: 0.67 to 0.93%

(5) The product of Shore D hardnesses of inner and outer cover layers: 3,500 to 4,000

$V_R$: 0.62 to 0.88%

With respect to the aforementioned range, if the value of $V_R$ relative to the product of Shore D hardnesses deviates from the specified range, the result is a prematurely falling trajectory and a reduced flight distance.

The value $V_R$ is the sum of volumes Vp of dimple spaces defined in the golf ball surface to be described later and is calculated according to the following equation:

$$V_R = \frac{Vs}{\frac{4}{3}\pi R^3} \times 100$$

wherein Vs is the sum of the volumes Vp of dimple spaces each below a circular plane circumscribed by the dimple edge and R is a ball radius.

It is noted that Vs in the above equation is represented by the following equation and $V_R$ can be calculated by substituting the value of Vs into the above equation of $V_R$.

$$Vs = N_1 Vp_1 + N_2 Vp_2 + \ldots + N_n Vp_n = \sum_{i=1}^{n} N_1 Vp_1$$

$Vp_1$, $Vp_2$, . . . $Vp_n$ represent the volumes of dimples of different dimensions and $N_1$, $N_2$, . . . $N_n$ represent the number of dimples having the volumes $Vp_1$, $Vp_2$, . . . $Vp_n$, respectively.

In addition to the above-mentioned requirement of $V_R$ value, the dimples formed in the golf ball of the invention must further satisfy the requirement that there are included at least three types of dimples which are different in at least one of a diameter, a depth, and a value $V_0$ which is the volume of one dimple space defined below a plane circumscribed by the dimple edge divided by the volume of a cylinder whose bottom is the plane and whose height is the maximum depth of the dimple from the bottom. If the number of dimple types is less than 3, there arises the problem that the golf ball lofts too high or drops prematurely.

Figure 2:
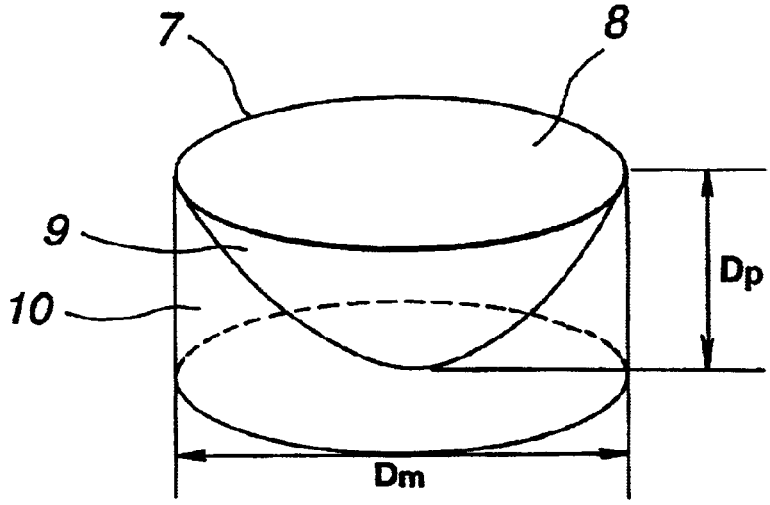
FIG. 2 is a perspective view of the dimple illustrating how to calculate a value $V_0$.
Figure 3:
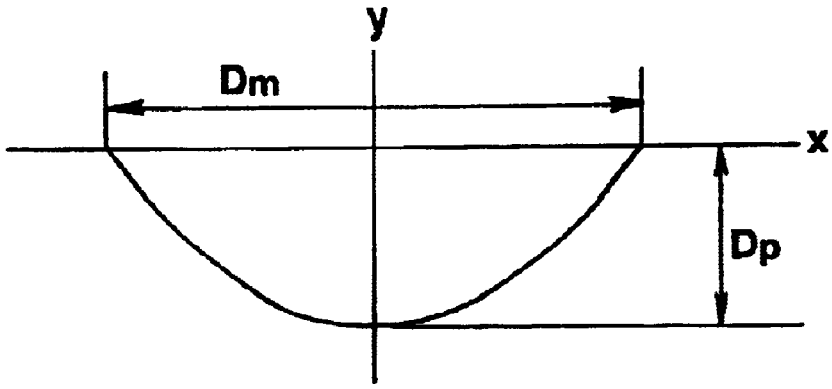
FIG. 3 is a cross-sectional view of the dimple illustrating how to calculate a value $V_0$.
Figure 4:
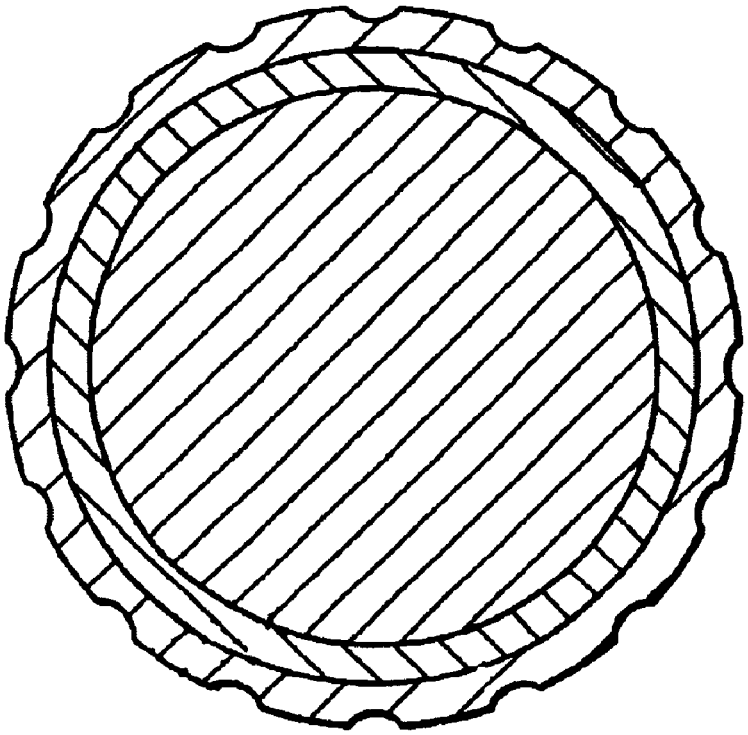
FIG. 4 is a cross-section of the solid golf ball of this invention.

The value $V_0$ associated with the dimple requirement is described below. In the event that the planar shape of a dimple is circular, as shown in FIG. 1, a phantom sphere 2 having-the ball diameter and another phantom sphere 3 having a diameter smaller by 0.16 mm than the ball diameter are drawn in conjunction with a dimple 1. The circumference of the other sphere 3 intersects with the dimple 1 at a point 4. A tangent 5 at intersection 4 intersects with the phantom sphere 2 at a point 6 while a series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a plane 8 (circle having a diameter Dm). Then, the dimple space 9 located below the plane 8 as shown in FIGS. 2 and 3 has a volume Vp. A cylinder 11 whose bottom is the plane 8 and whose height is the maximum depth Dp of the dimple from the plane 8 has a volume Vq. The ratio $V_0$ of the dimple space volume Vp to the cylinder volume Vq is calculated.

$$Vp = \int_0^{\frac{Dm}{2}} 2\pi xy\,dx$$

$$Vq = \frac{\pi Dm^2 Dp}{4}$$

$$V_0 = \frac{Vp}{Vq}$$

In the event that the planar shape of a dimple is not circular, the maximum diameter or length of a dimple is determined, the plane projected shape of the dimple is assumed to be a circle having a diameter equal to this maximum diameter or length, and $V_0$ is calculated as above based on this assumption.

With respect to having dimples of different types according to the invention, dimples of the largest type preferably have a diameter of 3.7 to 4.5 mm, especially 3.8 to 4.3 mm and a depth of 0.15 to 0.25 mm, especially 0.155 to.0.23 mm, and their number is preferably 5 to 80%, especially 10 to 75% of the total dimple number. They are preferably set to have a $V_0$ value of 0.38 to 0.55. More preferably $V_0$ is 0.4 to 0.52.

Among the dimples of different types, dimples of the smallest type preferably have a diameter of 2.0 to 3.7 mm, especially 2.4 to 3.6 mm and a depth of 0.08 to 0.23 mm, especially 0.09 to 0.21 mm, and their number is preferably 1 to 40%, especially 2 to 30% of the total dimple number. They are preferably set to have a $V_0$ value of 0.38 to 0.55, especially 0.4 to 0.52.

The golf ball as a whole should preferably have a $V_0$ value of 0.38 to 0.55, more preferably 0.4 to 0.52, especially 0.42 to 0.5. A $V_0$ value of less than 0.38 is likely to lead to a non-long-lasting trajectory whereas a $V_0$ value of more than 0.55 is likely to lead to a high rise or aloft trajectory.

In the practice of the invention, the total number of dimples is not critical although usually 360 to 460 dimples, especially 370 to 450 dimples are formed.

The golf ball of the invention can be used as tournament golf balls and constructed in accordance with the Rules of Golf to a diameter of not less than 42.67 mm and a weight of not greater than 45.93 grams.

The multi-piece solid golf ball of the invention has the advantages that various properties including spin, feeling and durability inherent to the multi-piece construction are further improved and an increased flight distance is expected due to the elimination of a high rise or dropping trajectory.

EXAMPLE

Examples of the present invention are given below together with Comparative Examples by way of illustration and not by way of limitation.

Examples and Comparative Examples

Solid cores having a diameter of 36.7 mm were prepared by mixing a rubber composition of the formulation shown in Table 1 in a roll mill and heat compression molding the composition at 155° C. for 15 minutes.

Each solid core was enclosed with cover stocks shown in Table 2 in the order shown in Tables 4 and 5 to form an inner cover layer and an outer cover layer. The outer cover layer on the surface was formed with dimples shown in Tables 3, 4, and 5. Three-piece solid golf balls were obtained in this way.

The golf balls thus obtained were examined for flight distance and trajectory by the following tests. The results are shown in Tables 4 and 5.

Flight Performance

Using a swing robot by True Temper Co., the ball was hit with a driver at a head speed of 48 m/sec. (#W1/HS48) to measure a spin, carry and total distance.

Trajectory

Twelve golf balls of each example were hit under the same conditions as in the flight performance test to visually observe a trajectory.

TABLE 1

| Solid core composition (pbw) | I | II | III | IV |
|---|---|---|---|---|
| 1,4-polybutadiene (cis structure) | 100 | 100 | 100 | 100 |
| Zinc acrylate | 32 | 32 | 23 | 33 |
| Dicumyl peroxide | 1.2 | 1.2 | 1.2 | 1.2 |
| Antioxidant | 0.1 | 0.1 | 0.1 | 0.1 |
| Zinc oxide | 5 | 5 | 5 | 4 |
| Barium sulfate | 13.2 | 23.1 | 26.8 | 0 |
| Peptizer | 1 | 1 | 1 | 0 |

TABLE 2

| Cover stock (pbw) | A | B | C | D | E | F |
|---|---|---|---|---|---|---|
| Hytrel 4047 | 100 | — | — | — | — | — |
| Surlyn 8120 | — | 50 | — | 30 | — | — |
| Himilan 1557 | — | 50 | — | — | — | 50 |
| Himilan 1856 | — | — | 90 | — | — | — |
| NO825J | — | — | 10 | — | — | — |
| Himilan 1605 | — | — | — | 20 | — | 50 |
| Himilan 1706 | — | — | — | 50 | — | — |
| PANDEX T-7890 | — | — | — | — | 100 | — |

Hytrel 4047: Toray duPont K.K., polyester base thermoplastic elastomer
NO825J: Mitsui duPont K.K., ethylene/methacrylic acid/methacrylate ter-polymer (nuclel)
Surlyn 8120: E. I. duPont, ionomer resin
Himilan 1557: Mitsui duPont Polychemicals K.K., ionomer resin
Himilan 1856: Mitsui duPont Polychemicals K.K., ionomer resin
Himilan 1605: Mitsui duPont Polychemicals K.K., ionomer resin
Himilan 1706: Mitsui duPont Polychemicals K.K., ionomer resin
PANDEX T-7890: Dai-Nihon Ink Chemical Industry K.K., thermoplastic polyurethane elastomer Note that an appropriate amount of titanium dioxide was blended in resin compositions A to F.

TABLE 3

| Type | Diameter (mm) | Depth (mm) | $V_0$ | Number | $V_R$ (%) |
|---|---|---|---|---|---|
| 1 | 4.100 | 0.195 | 0.440 | 32 | 0.89 |
| | 4.200 | 0.195 | 0.440 | 40 | |
| | 4.000 | 0.195 | 0.440 | 184 | |
| | 3.900 | 0.195 | 0.440 | 16 | |
| | 3.400 | 0.195 | 0.440 | 104 | |
| | 3.350 | 0.195 | 0.440 | 16 | |
| 2 | 4.100 | 0.210 | 0.450 | 32 | 0.86 |
| | 4.200 | 0.180 | 0.450 | 40 | |
| | 4.000 | 0.165 | 0.450 | 184 | |
| | 3.900 | 0.200 | 0.450 | 16 | |
| | 3.400 | 0.155 | 0.450 | 104 | |
| | 3.350 | 0.160 | 0.450 | 16 | |
| 3 | 3.850 | 0.160 | 0.500 | 288 | 0.80 |
| | 3.250 | 0.150 | 0.500 | 72 | |
| | 2.500 | 0.140 | 0.500 | 42 | |
| 4 | 3.850 | 0.175 | 0.525 | 288 | 0.93 |
| | 3.250 | 0.170 | 0.530 | 72 | |
| | 2.500 | 0.170 | 0.530 | 42 | |
| 5 | 4.000 | 0.160 | 0.480 | 114 | 0.77 |
| | 4.000 | 0.180 | 0.480 | 42 | |
| | 3.650 | 0.140 | 0.480 | 180 | |
| | 3.600 | 0.140 | 0.480 | 24 | |
| | 2.550 | 0.100 | 0.480 | 60 | |
| 6 | 3.900 | 0.150 | 0.470 | 240 | 0.66 |
| | 3.200 | 0.150 | 0.470 | 120 | |
| 7 | 3.850 | 0.170 | 0.465 | 340 | 1.04 |
| | 3.600 | 0.170 | 0.465 | 140 | |
| 8 | 3.850 | 0.185 | 0.460 | 340 | 1.12 |
| | 3.600 | 0.185 | 0.460 | 140 | |

TABLE 4

| | | E1 | E2 | E3 | E4 | E5 |
|---|---|---|---|---|---|---|
| Solid core | Composition | I | II | III | IV | III |
| | Hardness* (mm) | 3.0 | 3.0 | 4.5 | 2.8 | 4.5 |
| Inner cover layer | Stock | A | C | D | A | B |
| | Shore D hardness | 40 | 49 | 55 | 40 | 58 |
| | Gage (mm) | 1.5 | 1.5 | 1.5 | 1.5 | 1.5 |
| Outer cover layer | Sotck | B | D | B | E | F |
| | Shore D hardness | 58 | 55 | 58 | 42 | 60 |
| | Gage (mm) | 1.5 | 1.5 | 1.5 | 1.5 | 1.5 |
| Dimple type | | 1 | 2 | 3 | 4 | 5 |
| Inner layer Shore D × outer layer Shore D | | 2320 | 2695 | 3190 | 1680 | 3480 |
| $V_R$ (%) | | 0.89 | 0.86 | 0.80 | 0.93 | 0.77 |
| #W1/HS48 | Spin (rpm) | 2530 | 2540 | 2450 | 2680 | 2250 |
| | Carry (m) | 225 | 229 | 228 | 228 | 227 |
| | Total (m) | 255 | 257 | 258 | 257 | 258 |
| Trajectory | | somewhat rising, long-lasting, relatively low trajectory | rising, similar to balata ball | liner-like, long-lasting, medium trajectory | rising, similar to balata ball | liner-like, long-lasting, medium trajectory |

*a distortion (mm) of the solid core under an applied load of 100 kg

TABLE 5

| | | CE1 | CE2 | CE3 |
|---|---|---|---|---|
| Solid core | Composition | I | III | IV |
| | Hardness* (mm) | 3.0 | 4.5 | 2.8 |
| Inner cover layer | Stock | A | D | A |
| | Shore D hardness | 40 | 55 | 40 |
| | Gage (mm) | 1.5 | 1.5 | 1.5 |
| Outer cover layer | Stock | B | B | E |
| | Shore D hardness | 58 | 58 | 42 |
| | Gage (mm) | 1.5 | 1.5 | 1.5 |
| Dimple type | | 6 | 7 | 8 |
| Inner layer Shore D × outer layer Shore D | | 2320 | 3190 | 1680 |
| $V_R$ (%) | | 0.73 | 1.04 | 1.12 |
| #W1/HS48 | Spin (rpm) | 2530 | 2450 | 2680 |
| | Carry (m) | 220 | 218 | 217 |
| | Total (m) | 247 | 243 | 245 |
| Trajectory | liner-like, high | liner-like, low, dropping | liner-like, low, dropping | |

*a distortion (mm) of the solid core under an applied load of 100 kg

As seen from the results of Examples, the multi-piece solid golf balls of the invention exhibit a satisfactory trajectory and are excellent in all of spin, carry, and total flight distance.

In contrast, the multi-piece solid golf ball of Comparative Example 1 wherein $V_R$ is below the specified range associated with the product of the Shore D hardnesses of the inner and outer cover layers was inferior in flight distance performance. The multi-piece solid golf balls of Comparative Examples 2 and 3 wherein $V_R$ is above the specified range was inferior in flight distance performance and exhibited a dropping trajectory.

What is claimed is:

1. A multi-piece solid golf ball comprising; a solid core and a cover consisting of inner and outer layers surrounding the core, the outer cover layer having a surface formed with a plurality of dimples, a product of the Shore D hardness of said inner cover layer multiplied by the Shore D hardness of said outer cover layer and a proportion $V_R$ (%) of the total of the volumes of dimples spaces each defined below a plane circumscribed by the dimple edge to the overall volume of a phantom sphere given on the assumption that the golf ball surface is free of dimples satisfying the following relationship:

the product of Shore D hardnesses of inner and outer cover layers: 2,500 to less than $V_R$: 0.7 to 1%, and said dimples including at least three types of dimple which are different in at least one of a diameter, a depth, and a value $V_O$ which is the volume of one dimple space defined below a plane circumscribed by the dimple edge divided by the volume of a cylinder whose bottom is the plane and whose height is the maximum depth of the dimple from the bottom, wherein the dimples of the largest type have the diameter of 3.7 to 4.5 mm, the depth of 0.15 to 0.25 mm and the $V_0$ value of 0.38 to 0.55, and their number is 5 to 80% of the total dimple number.

2. The multi-piece solid golf ball of claim 1 wherein both the hardnesses of the inner and outer cover layers are up to 63 in Shore D hardness.

3. The multi-piece solid golf ball of claim 1, wherein the hardness of the inner or outer cover layers is up to 63 in Shore D hardness.

4. The multi-piece solid golf ball of claim 1, wherein the number of said dimples is 370 to 450.

5. The multi-piece solid golf ball of claim 1 wherein the dimples of the smallest type have the diameter of 2.0 to 3.7 mm, and the depth of 0.08 to 0.23 mm and $V_0$ value of 0.38 to 0.55, and their number is 1 to 40% of total dimple number.

6. The multi-piece solid golf ball of claim 1 wherein the inner cover layer has a gage of 0.5 to 3.0 mm.

7. The multi-piece solid golf ball of claim 6 wherein the outer cover layer has a gage of 0.5 to 2.5 mm.

8. The multi-piece solid golf ball of claim 1 wherein the cover has a total gage of 1.0 to 5.5 mm.

9. The multi-piece solid golf ball of claim 1 wherein the inner cover layer and the outer cover layer have a Shore D hardness of 28 to 63 and of 30 to 62, respectively.

10. The multi-piece solid golf ball of claim 1, wherein said solid core has a distortion of 2.8 to 6.0 mm under load of 100 kg.

11. The multi-piece solid golf ball of claim 1, wherein the number of smallest dimples (diameter of 2.0 to 3.7 mm) is 2 to 30% of the total dimples.

12. A multi-piece solid golf ball comprising; a solid core and a cover consisting of inner and outer layers surrounding the core, the outer cover layer having a surface formed with a plurality of dimples, a product of the Shore D hardness of said inner cover layer multiplied by the Shore D hardness of said outer cover layer and a proportion $V_R$ (%) of the total of the volumes of dimple spaces each defined below a plane circumscribed by the dimple edge to the overall volume of a phantom sphere given on the assumption that the golf ball surface is free of dimples satisfying the following relationship:

the product of Shore D hardnesses of inner and outer cover layers: 2,500 to less than 3,000

$V_R$: 0.7 to 1%, and said dimples including at least three types of dimples which are different in at least one of a diameter, a depth, and a value $V_0$ which is the volume of one dimple space defined below a plane circumscribed by the dimple edge divided by the volume of a cylinder whose bottom is the plane and whose height is the maximum depth of the dimple from the bottom, wherein the dimples of the smallest type have the diameter of 2.0 to 3.7 mm, the depth of 0.08 to 0.23 mm and the $V_0$ value of 0.38 to 0.55, and their number is 1 to 40% of the total dimple number.

13. The multi-piece solid golf ball of claim 12, wherein the hardness of the inner or outer cover layers is up to 63 in Shore D hardness.

14. The multi-piece solid golf ball of claim 12, wherein the number of said dimples is 370 to 450 .

15. The multi-piece solid golf ball of claim 12 wherein the inner cover layer has a gage of 0.5 to 3.0 mm.

16. The multi-piece solid golf ball of claim 12 wherein the outer cover layer has a gage of 0.5 to 2.5 mm.

17. The multi-piece solid golf ball of claim 12 wherein the cover has a total gage of 1.0 to 5.5 mm.

18. The muti-piece solid golf ball of claim 12 wherein the inner cover layer and the outer cover layer have a Shore D hardness of 28 to 63 and of 30 to 62 , respectively.

19. The multi-piece solid golf ball of claim 12, wherein said solid core has a distortion of 2.8 to 6.0 mm under load of 100 kg.

20. The multi-piece solid golf ball of claim 12, wherein the number of smallest dimples (diameter of 2.0 to 3.7 mm) is 2 to 30% of the total dimples.

* * * * *